United States Patent [19]

Geissler

[11] Patent Number: 4,609,976

[45] Date of Patent: Sep. 2, 1986

[54] COMBINATION FLASHLIGHT AND WARNING LIGHT

[75] Inventor: Udo Geissler, Munich, Fed. Rep. of Germany

[73] Assignee: Patent-Treuhand-Gesellschaft fur elektrische Gluhlampen mbH, Munich, Fed. Rep. of Germany

[21] Appl. No.: 717,706

[22] Filed: Mar. 29, 1985

[30] Foreign Application Priority Data

Apr. 3, 1984 [DE] Fed. Rep. of Germany ..... 3412437

[51] Int. Cl.[4] ..... F21L 7/00

[52] U.S. Cl. ..... 362/202; 362/167; 362/188; 362/196

[58] Field of Search ..... 362/196, 202, 167, 174, 362/178, 188, 155, 362, 277, 285

[56] References Cited

U.S. PATENT DOCUMENTS

| | | | |
|---|---|---|---|
| 1,608,195 | 11/1926 | Barany | 362/188 |
| 1,674,650 | 6/1928 | Leser | 362/188 |
| 4,286,311 | 8/1981 | Maglica | 362/202 |
| 4,307,439 | 12/1981 | Sassmannshausen | 362/188 |

FOREIGN PATENT DOCUMENTS

| | | | |
|---|---|---|---|
| 898236 | 6/1962 | United Kingdom | 362/202 |

*Primary Examiner*—Magdalen Y. C. Greenlief

*Attorney, Agent, or Firm*—Frishauf, Holtz, Goodman, & Woodward

[57] ABSTRACT

To provide for maximum light intensity in a selected mode of operation—torch or flashlight mode or warning flasher mode, an elongated tubular housing has a body portion (2) and a head portion (3), the two portions being connected together by a hollow tube (17) secured preferably to the head portion (3) and slideable within the body portion. A reflector system (5) is secured to the head portion, and the halogen incandescent lamp seated on the body portion. For flashlight operation, the reflector system is fitted over the halogen incandescent lamp, and light from the lamp is directed axially outwardly of the flash lamp; for blinker operation, the entire head portion is pulled upwardly, along with the reflector for a distance, such that the reflector will clear the halogen incandescent lamp (16), thus providing for 360° light radiation—with respect to the axis of the lamp—and essentially directing all light from the halogen incandescent lamp for blinder or warning purposes. The tubular element (17) preferably is ribbed, and colored with a warning color, such as amber or red.

17 Claims, 2 Drawing Figures

COMBINATION FLASHLIGHT AND WARNING LIGHT

Reference to related application, assigned to the assignee of the present application, the disclosure of which is hereby incorporated by reference: U.S. Ser. No. 06/717,702, filed Mar. 29, 1985, KRIEG.

The present invention relates to a combination flashlight and warning light, and more particularly to such a combination which uses a halogen incandescent lamp as a light source.

BACKGROUND

Halogen incandescent lamps provide about four times as much light output than ordinary miniature incandescent lamps. Flashlights using halogen incandescent lamps, thus, are eminently suitable as emergency light sources, and they can also readily be connected to warning flashers, by incorporating any suitable flashing circuitry with the flash lamps.

Flashlights of the type to which the present invention relates usually have a head portion with a reflector to concentrate light from the light source—in the present case the halogen incandescent lamp—and have a housing body portion to receive primary, or rechargeable batteries. Flashlights with halogen incandescent lamps increasingly penetrate the market. By shifting the head portion of the flashlight, by a sliding connection, with respect to the body portion, it has been possible to change the light distribution derived from the light source itself. The cone angle of light reflected by the reflector thus could be changed. Yet, the sliding connection left the reflector in light-reflective reflective relationship with respect to the light source—in other words, the bulb remained always within the reflector system. While this permits changing the cone angle of the emitted light, or the light distribution on an imaging surface, all-around illumination was not possible.

Emergency or warning light sources heretofore used only miniature incandescent lamps of standard construction. Usually, they provide a yellow warning flashing light, and, alternatively, white continuous light, with a narrow beam. Frequently, two different bulbs were used to, selectively, provide the flashing warning light or the concentrated beam. Use of two bulbs is costly and results in a complex construction of the flashlight-warning light combination. It has been proposed to provide flashlights-warning lights with only a single bulb. In such arrangements, the head of the flashlight usually is made of a yellow plastic material, with a clear transparent cover at the head end. The reflector, in such arrangements, is so placed that, in continuous illumination as well as in flashing illumination, light is always emitted towards all sides. Thus, both the clear transparent cover, as well as the remaining yellow plastic portion of the flashlight is illuminated. If flash lamp use is made of, light is lost due to the illumination of the yellow transparent warning region of the flashlight head; if only warning is to be intended, light is lost because some is transmitted through the transparent end portion, otherwise used for torch, or flashlight use.

THE INVENTION

It is an object to provide a combination flashlight-warning light, utilizing only a single halogen incandescent lamp and which can be selectively connected to provide either a bright continuous light or a colored, for example yellow, warning flashing light, and in which, regardless of the operating mode selected, essentially the entire light flux, or light energy derived from the halogen incandescent lamp is available in the selected operating mode with a minimum amount of loss of light, absorption, or stray light radiation.

Briefly, a slideable connection is provided between the head portion of the flashlight and a body portion, in which the body portion has the battery compartment therein and retains the halogen incandescent lamp. The reflector portion is located on the slideable connection. In accordance with a feature of the invention, the slideable connection is so arranged that the reflector portion can be pulled off completely over the head of the halogen incandescent lamp, exposing the halogen incandescent lamp, without any directing reflector, so that, with respect to the longitudinal axis of the flash lamp, the halogen incandescent lamp will be able to provide 360° radiation. In this mode, a connecting switch of standard and suitable construction can energize a flashing circuit—also as well known in the standard construction—to provide a warning flashing light if desired. The sliding connection itself preferably is made of a transparent color plastic, for example amber or red. Upon pushing the sliding connection of the head portion, together with the reflector system, towards the body portion of the flash lamp, the halogen incandescent bulb will be surrounded by the reflector system and provide all its light in accordance with the reflector system, for example through a lens system or the like to a transparent head closure.

It is not necessary that the entire bulb of the halogen incandescent lamp be cleared by the reflector when 360° illumination is desired; it is sufficient that the portion surrounding the filament of the halogen incandescent lamp is free from the reflector.

In accordance with a preferred form, the sliding connection is made by a hollow, cylindrical tube which permits shifting of the head portion of the flash lamp-warning light combination and which surrounds at least the halogen incandescent lamp, and is sufficient region therebeyond to ensure axial guidance and sliding. Preferably, the tube, in the area surrounding the lamp is transparent; it may be made of glass or, more desirably, of plastic.

DRAWINGS

FIG. 1 is a longitudinal side view, half of it in section, of a lamp in accordance with the present invention in which the lamp is in a position for operation as a torch, or flashlight; and FIG. 2 illustrates the same lamp, with the head portion pulled upwardly, for operation in accordance with a warning blinker light.

DETAILED DESCRIPTION

Figure 1:
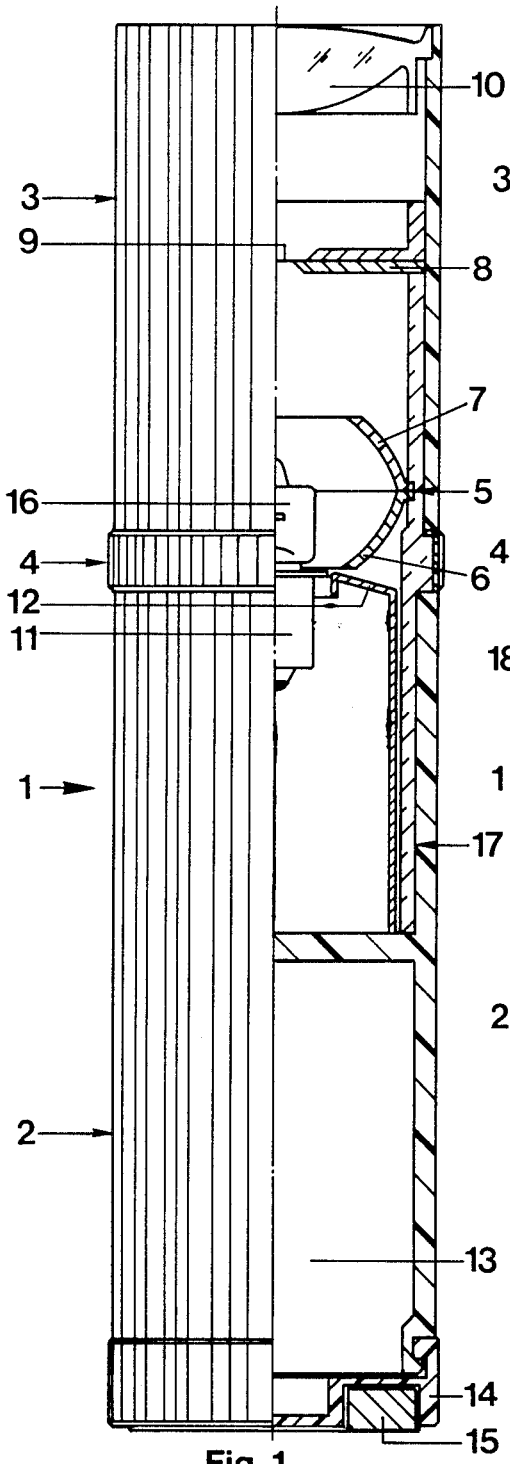

The flashlight-warning light combination 1 has a cylindrical housing, preferably of plastic, of about 18 cm length, with an outside diameter of about 4 cm. The housing includes a body portion 2 and a head portion 3. The head portion 3 is axially slideable with respect to the body portion 2 and, additionally, rotable about a longitudinal axis of the flashlight-warning light combination. Both the body portion, as well as the head portion, have the same external diameter and are optically separated from each other by a metal ring 4 which is coupled to the head portion 3. The head portion 3 carries a reflector 5 at an end zone thereof facing the body portion 2. The reflector 5 includes an elliptical reflector portion 6 and a part spherical reflector portion 7.

A diaphragm 8 with variable diaphragm opening 9 is located downstream—in the direction of the light beam—from the reflector 5; the head portion is closed off by a aspherical condenser, or focussing lens 10.

The body portion 2 of the flashlight-warning light combination carries a lamp socket 11 which is secured to a holder 12, socket 11 thus is secured to the housing by the holder 12. A chamber 13 is defined within the body portion to receive batteries, for example four cells selectively, of the primary type, or the rechargeable type, that is, batteries having an axial length of about 4.9 cm and a diameter of about 1.3 cm also referred to as "A" size batteries. The body portion is closed off at its lower end by a bottom cover 14, for example with a screw, or bayonnet connection. The cover 14 carries a ring magnet 15, recessed into the cover, in order to permit ready attachment of the combination 1 to a ferromagnetic carrier, for example the body of an automotive vehicle.

Operation (1) Flashlight or torch use, with reference to FIG. 1: white, beam-like light is obtained by placing the halogen incandescent lamp 16 within the reflector 5 as shown in FIG. 1. In this position, the head 3 with the metal ring 4 is fitted closely against the body portion 2. The bulb of the halogen incandescent lamp 16 is received entirely within the reflector 5. By rotating the head 3, a switching mechanism of any suitable and well-known construction, and not shown in the drawings for simplicity, closes an electrical circuit from batteries—not shown—to the halogen incandescent lamp. Light will be emitted in the direction of the longitudinal axis of the combination through the aspherical lens 10. By additional rotation of the head portion 3, the diaphragm opening 9 can be changed, and thus different light cone angles can be generated. Preferably, the diaphragm opening 9 is located at the second focal point of the theoretical ellipse defined by the elliptical reflector portion 6. The filament of the halogen incandescent lamp 16 is located at one of the focal points of this theoretical ellipse. The referenced copending application Ser. No. 06/717,702, filed Mar. 29, 1985 is here referred to.

Figure 2:
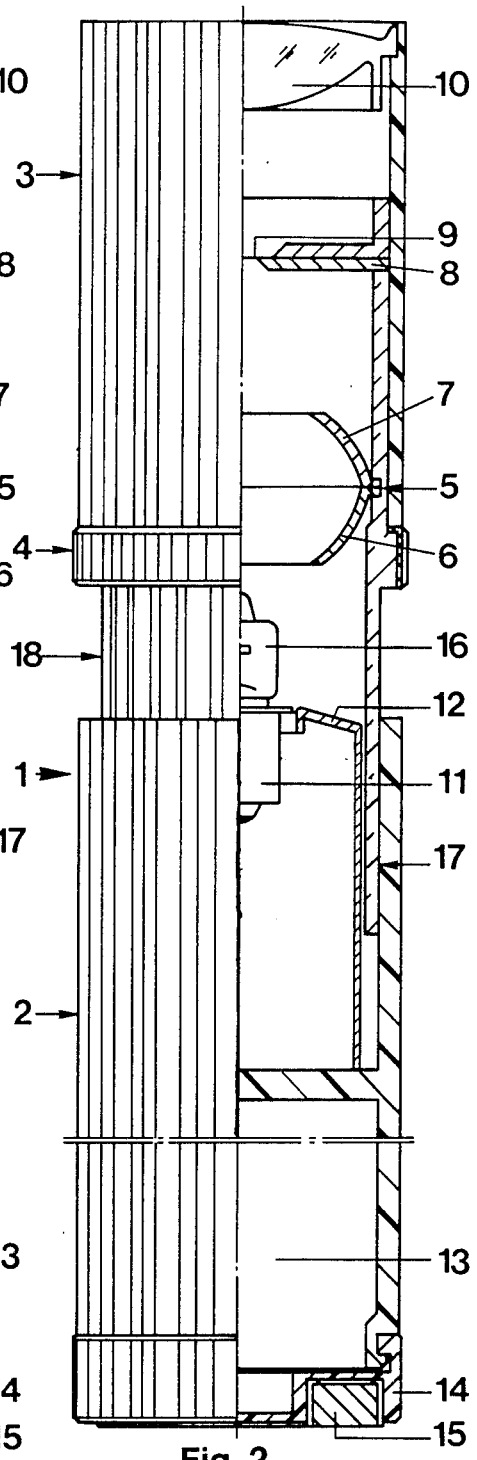

(2) Warning blinker mode of operation: to generate a flashing warning light, extending in a direction perpendicularly to the longitudinal axis of the flash lamp, the head portion 3 is pulled upwardly to the position shown in FIG. 2. The head 3, by means of a hollow tube 17, which is securely connected to the head 3, is shifted forwardly along the inner wall of the body portion 2 for such a distance that the bulb of the halogen incandescent lamp 16—or at least the region around its filament—is completely free between the head portion 3 and the body portion 2—see FIG. 2. The halogen incandescent lamp 16 is laterally surrounded only by the portion 18 of the hollow cylindrical tube 17. This portion 18, preferably, is grooved or ribbed, and has a warning coloring, for example yellow. The tube 17, thus, can be made of a single sheet of yellow plastic material. which, in the region 18, shows the ribbing.

Light losses by absorption can be reduced by coating the backside of the elliptical reflector 6, the top side of the socket 11, and the top side of the holder 12 with reflective material.

Shifting the head portion 3 forward additionally operates an electrical switch which connects the batteries—now shown—to a suitable flashing circuit—not shown—of any standard construction to cause the halogen incandescent lamp 16 to flash intermittently.

The head portion, thus, can be pulled up from the body portion to such an extent that the entire halogen incandescent lamp 16 will be below or beneath the reflector system. The reflector system formed by the reflector portion 6,7 and the remaining optical system, the diaphragm 8 and the lens 10, are not coupled to the lamp itself. Rather, the reflector is so constructed that at its apex position, the opening is large enough to permit shifting the reflector clear of the bulb of the halogen incandescent lamp. Upon connection of the lamp, the light which is lost due to forward emission of light from the halogen incandescent lamp 16 through the apex opening of the reflector 6, will be small. Practically the entire light flux generated by the halogen incandescent lamp will be available for warning light indication in the operating mode illustrated in FIG. 2. The light output can be further enhanced by coating the backwall of the reflector 6, and all exposed surfaces adjacent the lamp 16, that is, the top side of the holder 12 and/or those portions of the socket 11 which are exposed with reflective material, or reflective paint.

The light output of the combination, when used in the torch, or flashlight mode, is highly efficient, and the entire light flux generated by the halogen incandescent lamp 16 is available for illumination forwardly through the lens 10 and along the longitudinal axis of the combination 1.

The hollow cylindrical tube 17 is preferably affixed to the head portion 3, since the body portion provides more room for optimal construction of a sliding arrangement. The alternative or reverse arrangement may be used, however, by coupling the hollow cylindrical tube 17 securely to the body portion 2 and coupling the reflector, and hence the sliding arrangement which removes the reflector from the position shown in FIG. 1 to that in the position shown in FIG. 2 with the head portion 2 alone.

The simplest arrangement provides for construction of the head portion 3 and the body portion 2 of plastic hollow cylindrical material of the same internal diameter, and utilizing the hollow cylindrical tube 17 as a guidance and sliding junction element, which has an outer diameter matching the inner diameter of the hollow cylinder defining the head portion 3 and the body portion 2, respectively. If, and as is preferable, the head portion 3 and the hollow cylindrical tube 17 are securely connected together, then it is only necessary to extend the tube 17 into the body portion 2 for a suitable distance to provide for axial guidance and to permit the sufficiently long sliding distance to clear the reflector 5 from the bulb of the halogen incandescent lamp 16. The inner wall of the body portion 2 then forms a sliding track for the extended end of the tube 17, permitting the tube 17 to slide along the inner surface of the body portion 2. This, also, permits construction of electrical slider switches which provide for wiping contacts; transition between torch use and warning light use is reliable, with practically no possibility of malfunction.

Ribbing, knurling, or otherwise corrugating the inner surface of the tube 17 in the region 18 provides for enhanced dispersion of light from the halogen incandescent lamp 16 in all directions, perpendicularly to the longitudinal axis of the combination 1. When making the tube 17 of plastic, fine facet elements can readily be formed therein, as the tube 17 is manufactured and molded.

Shifting the head portion 2 axially and/or rotating the head portion 2 provides for electrical switching operations by connecting the halogen incandescent lamp into respective continuous, or flashing circuitry, all of which is well known and any suitable such circuitry or switching arrangement may be used. Since the particular switching is a matter of routine design, the electrical connections have been omitted from the drawing for simplicity.

I claim:

1. Combination flashlight-warning light (1) having
an elongated tubular housing including
a cylindrical body portion (2) and a head portion (3) which is, at least in part, cylindrical;
an optical system (5, 8, 10) including a reflector (5) located within the housing;
a halogen incandescent lamp (16) located at an end zone of the body portion (2) facing the head portion (3),
the body portion (2) defining a battery chamber (13) therein;
means (17) axially slideably connecting the head portion (3) and the body portion (2) to provide for axially slideable movement of the head portion with respect to the body portion ,
wherein said slideable connection means (17) comprises
a hollow cylindrical tube (17) telescopically received within the cylindrical body portion (2) and the at least in part cylindrical head portion (3), said hollow cylindrical tube surrounding at least the halogen incandescent lamp, regardless of the sliding position of the hollow cylindrical tube, and wherein the portion (18) of the hollow cylindrical tube surrounding the halogen incandescent lamp (16) is transparent, said hollow cylindrical tube forming a connection element for said body portion (2) and said head portion (3) while permitting relative movement thereof; and
wherein, the reflector (5) is secured to the head portion (3) and the slideable connection means (17) has a slide distance large enough to remove the reflector secured to the head portion from the bulb of the halogen incandescent lamp and expose at least a filament of the halogen incandescent lamp (16) to a free space between the body portion (2) and the head portion (3) to provide for 360° light radiation—with respect to a longitudinal axis of the elongated tubular housing-from the halogen incandescent lamp (16).

2. Combination light according to claim 1, wherein said hollow cylindrical tube (17) is slideable within one (2) of said portions and secured to the other (3) of said portions of the tubular housing 3. Combination light according to claim 2, wherein the hollow cylindrical tube (17) is securely connected to the head portion (3).

4. Combination light according to claim 1, wherein the body portion (2) and the head portion (3) comprise hollow cylindrical elements having identical inner diameters; and
the hollow cylindrical tube (17) has an outer diameter fitting closely within the inner diameter of said body portion and head portion, said hollow cylindrical tube forming a slide guide for said axial sliding connection.

5. Combination light according to claim 4, wherein said hollow cylindrical tube is formed with a light-diffusing surface texture.

6. Combination light according to claim 5, wherein said light-diffusing surface texture comprises ribbing or facetting.

7. Combination light according to claim 3, wherein said hollow cylindrical tube has a projecting end extensions from said fixed connection with the head portion (3), into the body portion (2), which is at least twice the sliding distance of said tube to provide for longitudinal guidance of the head portion with respect to the body portion.

8. Combination light according to claim 1, further including a lamp holder (11,12) securing the halogen incandescent lamp (16) to the body portion (2);
and wherein the side of the lamp holder facing the bulb of the halogen incandescent lamp (16), as well as the side of the reflector (6), remote from the halogen incandescent lamp, when the halogen incandescent lamp is received within the reflector, have a reflective surface,
to provide for maximum light utilization and transmission in said 360° radius upon sliding said slideable connection means for the slide distance to remove the halogen incandescent lamp from the reflector.

9. Combination light according to claim 6 wherein the light diffusing surface is formed at the inner surface of said tube.

10. Combination light according to claim 1 wherein the tubular housing includes an end or bottom cover (14) remote from the optical system;
and a ring magnet (15) is provided, recessed into the bottom cover to permit attachment of said light combination to a ferromagnetic carrier.

11. Combination light according to claim 1 wherein the reflector (5) comprises a combination element having a first reflector section (6) formed by an elliptical reflector portion (6) defining a theoretical ellipse, and a second reflector section formed by a part spherical reflector portion (7), the wider opening of which faces the elliptical reflector portion (6) and located downstream—in a direction of the halogen incandescent lamp (16)—adjacent the elliptical reflector portion,
said reflector being coupled to the hollow cylindrical tube (7) and movable therewith to change the relative position of the reflector with respect to the halogen incandescent lamp;
and, wherein a lamp holder (11, 12) is provided, securing the halogen incandescent lamp (16) to the body portion (2) of the housing.

12. Combination flashlight-warning light (1) having
an elongated tubular housing including a hollow cylindrical body portion (2) and a hollow cylindrical head portion (3), said body portion and said head portion having identical inner diameters;
an optical system (5, 8, 10) including a reflector (5) located within the housing;
a halogen incandescent lamp (16) located at an end zone of the body portion (2) facing the head portion (3),
the body portion (2) defining a battery chamber (13) therein;
a hollow cylindrical tube (17) forming an axially slideable connection element, connecting the head portion (3) and the body portion (2) to provide for axially slideable movement of the head portion with respect to the body portion, the hollow cylindrical tube having an outer diameter fitting closely within the inner diameter of the body portion and the head portion, and forming a slide guide for said axially slideable movement;

and wherein the reflector (5) is secured to the head portion (3) and the hollow cylindrical tube (17) has a slide distance long enough to remove the reflector secured to the head portion from a bulb of the halogen incandescent lamp and expose at least the filament of the halogen incandescent lamp (16) to a free space between the body portion (2) and the head portion (3) to provide for 360° light radiation—with respect to a longitudinal axis of the elongated tubular housing—from the halogen incandescent lamp (16).

13. Combination light according to claim 12, wherein the hollow cylindrical tube (17) is securely connected to the head portion (3).

14. Combination according to claim 12, wherein said hollow cylindrical tube, at least in the region surrounding the halogen incandescent lamp, is transparent and formed with a light-diffusing surface texture.

15. Combination according to claim 14, wherein said light-diffusing surface texture comprises ribbing or facetting.

16. Combination according to claim 14, further including a lamp holder (11,12) securing the halogen incandescent lamp (16) to the body portion (2);

and wherein the side of the lamp holder facing the bulb of the halogen incandescent lamp (16), as well as the side of the reflector (6), remote from the halogen incandescent lamp, when the halogen incandescent lamp is received within the reflector, have a reflective surface, to provide for maximum light utilization and transmission in said 360° radius upon sliding said slideable connection means for the slide distance to remove the halogen incandescent lamp from the reflector.

17. Combination according to claim 14, wherein a lamp holder (11, 12 ) is provided, securing the halogen incandescent lamp (16) to the body portion (2) of the housing;

and, wherein the reflector (5) comprises a combination element having a first reflector section (6) formed by an elliptical reflector portion (6) defining a theoretical ellipse, and a second reflector section formed by a part spherical reflector portion (7), the wider opening of which faces the elliptical reflector portion (6) and located downstream—in a direction of the halogen incandescent lamp (16)—adjacent the elliptical reflector portion, said reflector being coupled to the hollow cylindrical tube (7) and movable therewith to change the relative position of the reflector with respect to the halogen incandescent lamp.

* * * * *